US005601253A

United States Patent [19]

Formon et al.

[11] Patent Number: 5,601,253

[45] Date of Patent: Feb. 11, 1997

[54] DISPENSER FOR ROLLED SHEET MATERIAL

[75] Inventors: John S. Formon, Marietta; Stephanie McIntyre, Atlanta, both of Ga.

[73] Assignee: Georgia-Pacific Corporation, Atlanta, Ga.

[21] Appl. No.: 530,897

[22] Filed: Sep. 20, 1995

[51] Int. Cl.[6] ..... B65H 16/08

[52] U.S. Cl. ..... 242/595.1

[58] Field of Search ..... 242/595.1, 594.1, 242/594.2, 560, 560.1, 560.2, 560.3, 561; 312/34.8, 34.19, 34.21, 34.22, 34.23, 34.24

[56] References Cited

U.S. PATENT DOCUMENTS

| | | | |
|---|---|---|---|
| D. 275,246 | 8/1984 | Lander . | |
| 993,416 | 5/1911 | Scott . | |
| 1,025,312 | 5/1912 | Rydquist . | |
| 1,122,673 | 12/1914 | Winter et al. . | |
| 1,423,336 | 7/1922 | Korittke . | |
| 1,693,877 | 12/1928 | Uttz . | |
| 2,299,736 | 10/1942 | Cavoto . | |
| 2,334,689 | 11/1943 | Wooster | 312/34.8 |
| 2,525,755 | 10/1950 | Aldrich . | |
| 2,606,724 | 8/1952 | Hertz . | |
| 2,839,346 | 6/1958 | Lawalin . | |
| 2,872,264 | 2/1959 | Nehring . | |
| 3,058,682 | 10/1962 | Mott et al. | 242/560.3 |
| 3,084,006 | 4/1963 | Roemer . | |
| 3,243,244 | 3/1966 | Morse et al. . | |
| 3,494,518 | 2/1970 | Goss . | |
| 3,580,651 | 5/1971 | Gauper . | |
| 3,690,580 | 9/1972 | Jespersen . | |
| 3,754,719 | 8/1973 | Choy . | |
| 3,865,295 | 2/1975 | Okamura | 242/560 |
| 4,223,964 | 9/1980 | Kilgore . | |
| 4,340,195 | 7/1982 | DeLuca | 242/560 |
| 4,497,453 | 2/1985 | Butcher . | |
| 4,844,361 | 7/1989 | Granger | 242/561 |
| 4,872,601 | 10/1989 | Sigmund . | |
| 4,944,466 | 7/1990 | Jespersen . | |
| 5,495,997 | 3/1996 | Moody | 242/560 |

*Primary Examiner*—John M. Jillions
*Attorney, Agent, or Firm*—Banner & Witcoff, Ltd.

[57] ABSTRACT

A dispenser for dispensing flexible sheet material from jumbo-sized rolls. The dispenser includes a housing containing a roll to be dispensed, and protecting the roll from the environment and from vandalism. The housing includes an opening at the bottom thereof to permit a user to withdraw the flexible sheet material. The dispenser includes at least one support roller adjacent the opening. Each support roller supports the roll by its lower periphery, facilitates the rotation of the roll, and maintains a portion of the periphery of the roll adjacent the opening. The housing further includes a wall, with a guide track, which is mounted to a restroom stall wall or another supporting surface. The dispenser also includes a guide mandrel which is slidably retained within the guide track, and is located inside the hollow core of the roll of flexible sheet material. The guide mandrel and guide slot direct the roll along a predetermined path during the entire dispensing of sheet material, and also assure that the roll is maintained in its proper position adjacent the dispenser opening. In addition, the support rollers, the guide slot, and the guide mandrel facilitate the withdrawal of sheet material from the dispenser and reduce the amount of force required to rotate the roll. This permits the sheet material on the roll to be perforated into sections along its length, which in turn, eliminates the need for any sharp or serrated edges normally used for tearing the sheet material.

41 Claims, 13 Drawing Sheets

DISPENSER FOR ROLLED SHEET MATERIAL

FIELD OF THE INVENTION

This invention relates to a dispenser for dispensing rolls of flexible sheet material, such as toilet tissue. More particularly, this invention relates to a dispenser for dispensing flexible sheet material from jumbo-sized rolls, which facilitates the withdrawal of the sheet material and eliminates the need for sharp and serrated edges normally used for tearing the sheet material.

BACKGROUND OF THE INVENTION

To reduce the maintenance required to provide users with a supply of toilet tissue in institutional and public restrooms, many manufacturers of toilet tissue have been producing "jumbo-sized" rolls. These jumbo-sized rolls are typically eight to thirteen inches in diameter, as opposed to the traditional-sized rolls which are four to five inches in diameter. Thus, the jumbo-sized rolls can hold about five to twelve times the amount of tissue as the traditional-sized rolls. Due to the large diameter of the jumbo-sized rolls, dispensers for these rolls are designed so that the axis of rotation of the roll is perpendicular to the dispenser wall mounted to the restroom wall. Heretofore, these dispensers have commonly included a fixed mandrel, typically near the center of the dispenser, to support the jumbo-sized roll as it is being dispensed. Further, these dispensers have typically included a bottom opening, bounded by surrounding edges, through which the users could withdraw tissue paper. At least one of these surrounding edges has been sharp and/or serrated enabling users to pull the tissue paper against this surrounding edge and tear the tissue paper from the roll for personal application. However, these dispensers may be disadvantageous for many reasons.

One disadvantage of these dispensers is that users may find it annoying and difficult to withdraw tissue paper. When a new jumbo-sized roll is installed in the dispenser, it is demanding to withdraw tissue paper because full and substantially full jumbo-sized rolls are heavy, and a large force must be applied by pulling the free end or tail of the roll, to rotate the roll around the fixed mandrel. Additionally, users must frequently extend their hands up into the dispenser to locate and pull the tail of the jumbo-sized tissue roll, which can be difficult and frustrating. This can occur when the jumbo-sized roll has been depleted a significant amount and the periphery of the roll is spaced from the dispenser opening, or when the tail of the roll inadvertently ends up on the bottom wall on the inside of the dispenser.

Another disadvantage associated with prior dispensers for jumbo-sized rolls is that users may accidentally scratch themselves on the sharp and/or serrated edges of the dispenser, which are intended for ripping the toilet tissue. Users are especially susceptible to being scratched when they are required to reach up into the dispenser to locate the tail of the tissue roll. Further, heretofore, it has not been practical to eliminate the sharp and/or serrated edges of the dispenser and use a jumbo-sized roll of perforated tissue paper, as a roll of perforated tissue paper is susceptible to undesirable tearing along its perforations when the necessary force to rotate the jumbo-sized roll is applied.

Therefore, a dispenser for jumbo-sized tissue rolls was thus needed which would eliminate sharp and serrated edges which can scratch the user, and which would facilitate the withdrawal of tissue paper throughout the dispensing process. The present invention was developed to accomplish these and other objectives.

SUMMARY OF THE INVENTION

In view of the foregoing, the present invention is directed to an improved dispenser for rolled sheet material, and more specifically, for dispensing flexible sheet material from jumbo-sized rolls.

The present invention provides a dispenser which facilitates the withdrawal of tissue paper, and eliminates the need for sharp or serrated edges on the dispenser housing.

The invention relates to a dispenser for storing and dispensing flexible sheet material from a roll having an axis of rotation, a periphery surface and a hollow core. The dispenser includes a housing for containing the roll of flexible sheet material to be dispensed, a guide mandrel, and a support member. The housing includes a first wall having a guide track, and an opening for dispensing the flexible sheet material from the roll therethrough. The guide, mandrel has a first portion slidably retained within the guide track, and a second portion positionable within the hollow core of the roll of flexible sheet material. The support member is mounted for rotation about a first axis located below the axis of rotation of the roll. Additionally, the support member is positioned adjacent the opening in contact with the periphery surface of the roll, and supports the roll during the dispensing of the flexible sheet material from the roll. The dispenser may also include a second rotatable support member positioned adjacent the opening in contact with the periphery surface of the roll, which also supports the roll during the dispensing of the flexible sheet material from the roll.

The present invention is also directed to a dispenser for storing and dispensing flexible sheet material from a roll having an axis of rotation, a periphery surface and a hollow core. The dispenser is adapted to be mounted to a planar supporting surface. The dispenser includes a housing, a guide track, a guide mandrel, and a support member. The housing contains the roll of flexible sheet material to be dispensed, and includes first and second opposing walls, and an opening for dispensing the flexible sheet material from the roll therethrough. The first wall is attached to the planar supporting surface. The guide track is located on the first wall and defines a path of travel for the roll as it is dispensed. The guide mandrel is positioned within the hollow core of the roll, and includes opposing first and second end portions. The first end portion is retained within the guide track for slidable movement with respect thereto, while the second end portion is located within the housing between the first and second walls. The support member contacts the periphery surface of the roll and supports the roll during the dispensing of flexible sheet material.

The present invention is also directed to a dispenser for storing and dispensing flexible sheet material from a roll. The roll has an initial diameter of at least eight inches, an axis of rotation, a periphery surface, and a hollow core. The dispenser includes a housing and roll supporting and guiding structure. The housing is sized to contain the roll of flexible sheet material, and includes an opening for withdrawing sheet material therethrough. The roll supporting and guiding structure supports the roll by its periphery and guides the roll along a predetermined path, during the entire dispensing of sheet material from the roll. A portion of the periphery of the roll is located adjacent the opening while the sheet material from the roll is being dispensed.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENT

Figure 1:
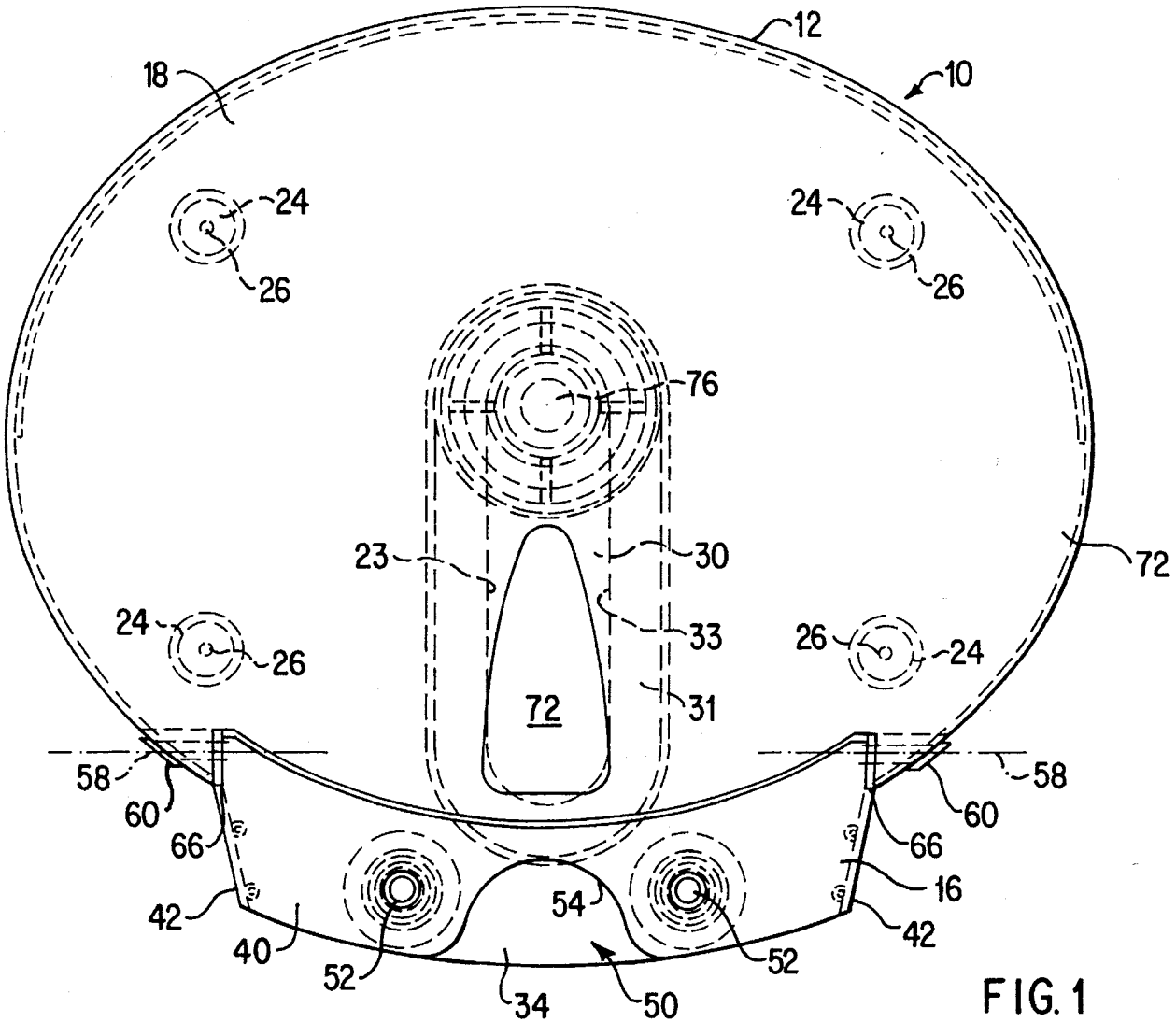
FIG. 1 is a front elevational view of the dispenser of the present invention shown in an unloaded state with the guide mandrel shown at the upper end of the guide track.

Referring to the drawings wherein like numerals indicate like elements, a dispenser, designated generally by reference numeral 10, is illustrated. Dispenser 10 houses and dispenses a roll of flexible sheet material, such as toilet tissue paper and the like, wound over cores. In a preferred embodiment, the rolled toilet tissue paper is preferably perforated into sheet sections of predetermined length, and is also of the "jumbo roll" type, e.g., between eight and thirteen inches in diameter. However, as will be apparent from the description hereinafter, the present invention is also advantageous for dispensing flexible sheet material from smaller sized rolls, and may also be used with rolls of non-perforated flexible sheet material.

In sum, and as depicted in FIGS. 17–20, a guide mandrel 76 receives and coaxially supports a dispensing roll 5 within the dispenser housing 12. Guide mandrel 76 is movably retained and guided within a guide track 30 in the rear of the dispenser housing 12 throughout the dispensing process, i.e., while sheet material 6 is being withdrawn and unrolled from dispensing roll 5. One or two support rollers 102 support the lower periphery of the dispensing roll 5 while the sheet material 6 is being dispensed and the guide mandrel 76 travels downward through the vertical guide track 30. The sheet material 6 is dispensed out through the bottom 50 of the housing 12 by a user pulling on the free end or tail 8 of the dispensing roll 5. As the dispensing roll 5 is being unwound, the guide mandrel 76 laterally guides the roll 5 with respect to the support rollers 102. The guide mandrel 76 and the support rollers 102 maintain the bottom periphery of the roll 5 adjacent the bottom 50 of the housing 12. The embodiment shown in FIGS. 1–20 uses two support rollers 102, while the embodiment shown in FIGS. 21 and 22 uses only one support roller 102'.

Figure 2:
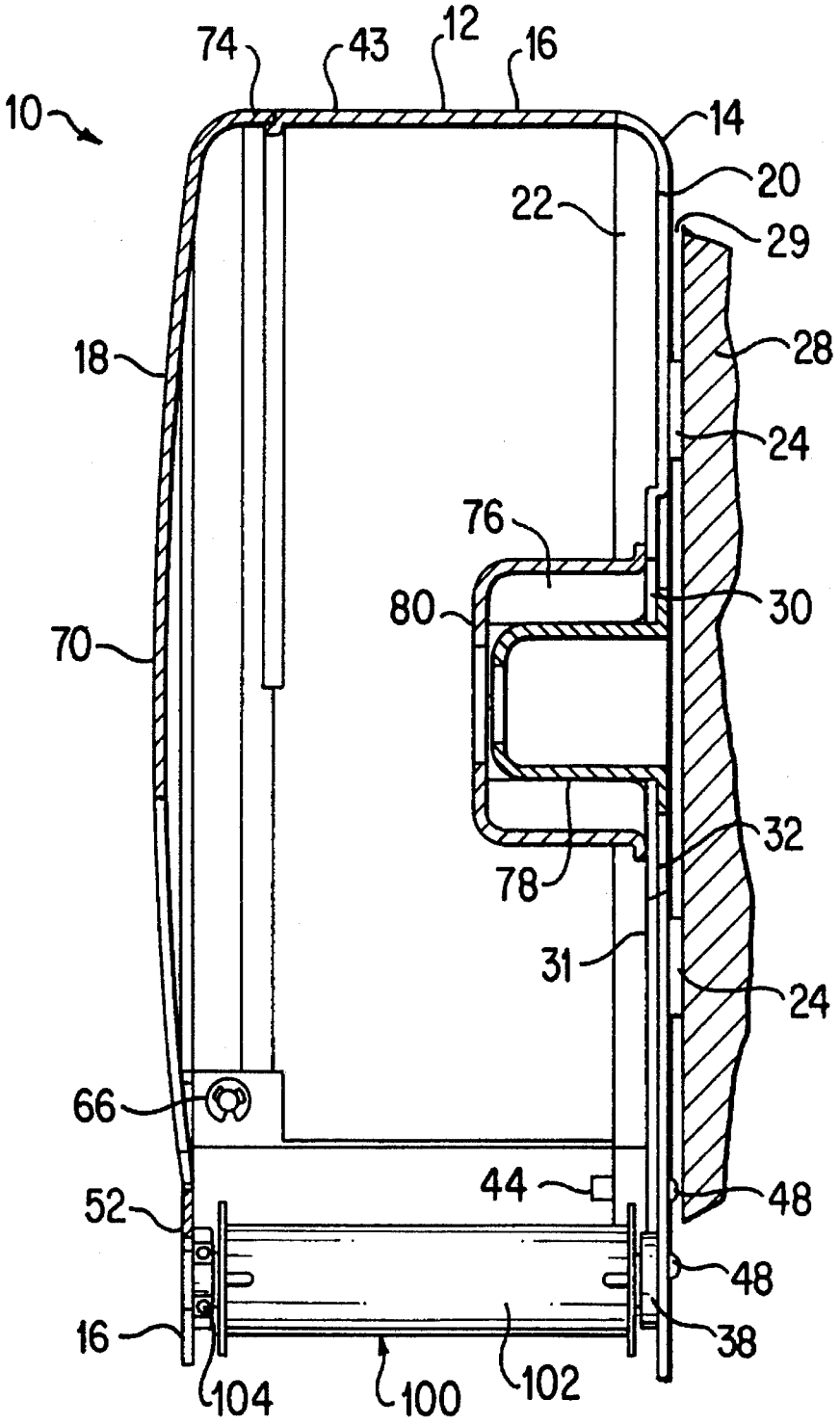
FIG. 2 is a side view of the dispenser of FIG. 1 shown partly in elevation and partly in section.
Figure 4:
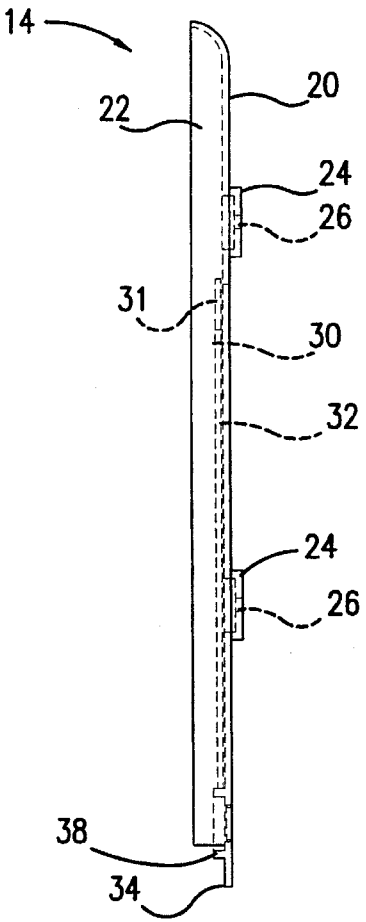
FIG. 4 is a right side elevational view of the rear shell of FIG. 3.
Figure 3:
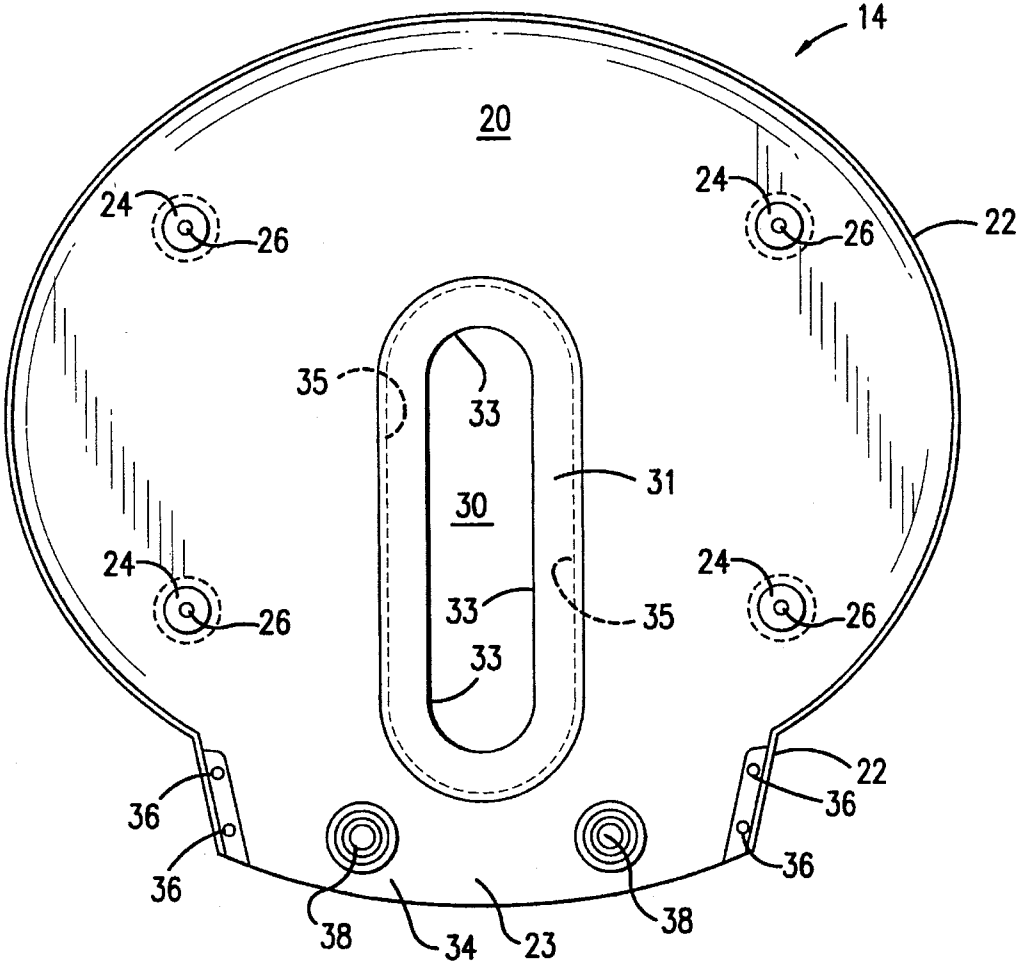
FIG. 3 is a front elevational view of the rear shell of the dispenser of FIG. 1.

As illustrated in FIGS. 1 and 2, dispenser 10 is defined by a housing 12 having a rear shell 14, a midsection 16 fixedly attached to the lower end of rear shell 14, and a cover 18 pivotally mounted near its lower end to midsection 16. Specifically referring to FIGS. 3 and 4, rear shell 14 forms a rear wall 20 and a partial side periphery wall 22 for housing 12. Partial side periphery wall 22 extends forwardly from rear wall 20 around the entire periphery of housing 12 except for a bottom region 23. Further, partial side periphery wall 22 helps to bound and protect the dispensing roll 5 around the sides and the top, while its open or interrupted area 23 in the bottom of the dispenser 10 permits the dispensing of the roll 5 therethrough.

Rear wall 20 may be mounted to a planar supporting surface 28, e.g. a wall, by the use of an adhesive, or by screws, not shown, passed through mounting slots or holes 26 in raised spacer members 24 formed in rear wall 20. In addition to facilitating the mounting of dispenser 10 to supporting surface 28, raised spacer members 24 also provide additional clearance 29 between rear wall 20 and supporting surface 28 assuring that the supporting surface 28 does not hinder the movement of the guide mandrel 76 in any manner.

Rear wall 20 further includes a vertical guide track or slot 30 for guiding the dispensing roll 5 within dispenser 10. As seen in FIGS. 2, 4, 15, and 16, vertical guide slot 30 is formed in a slightly inwardly projecting portion of the rear wall 20 around the periphery of guide slot 30. The inwardly projecting portion includes a forwardly facing surface 31 and a recessed rearwardly facing surface 32. Further, the guide slot 30 and rearwardly facing surface 32 include edge surfaces 33 and 35, respectively, which face the guide slot 30 and vertically and laterally retain guide mandrel 76. These surfaces 31–33 and 35 facilitate the guiding of guide mandrel 76 and dispensing roll 5, as described in detail hereinafter. Further, because surface 32 is recessed inwardly, it also provides clearance 29 further assuring that the supporting surface 28 does not hinder the movement of the guide mandrel 76 in any manner.

Rear wall 20 further includes a lower extending portion 34 which extends below the partial side periphery wall 22. This lower extending portion 34 includes mounting holes 36 for attaching the midsection 16 thereto, and two stepped bores 38, each for receiving one end of a respective roller support assembly 100.

Figure 6:
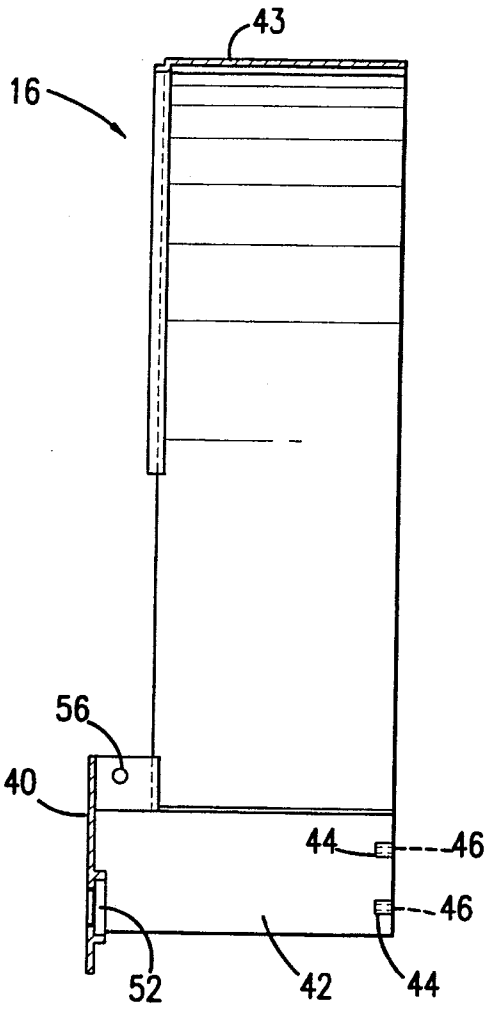
FIG. 6 is a cross-sectional view of the midsection taken along line 6—6 of FIG. 5.
Figure 5:
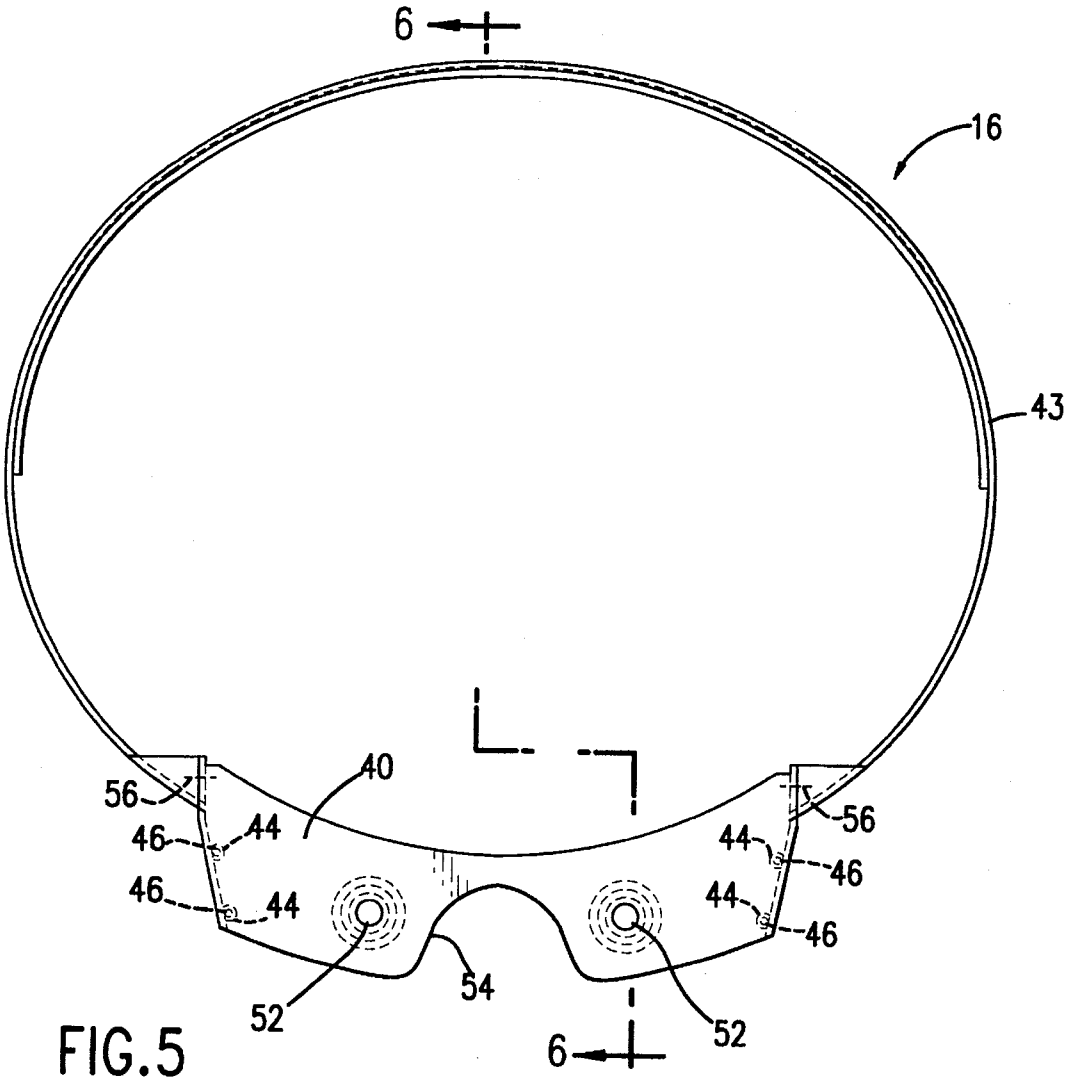
FIG. 5 is a front elevational view of the midsection of the dispenser of FIG. 1.
Figure 8:
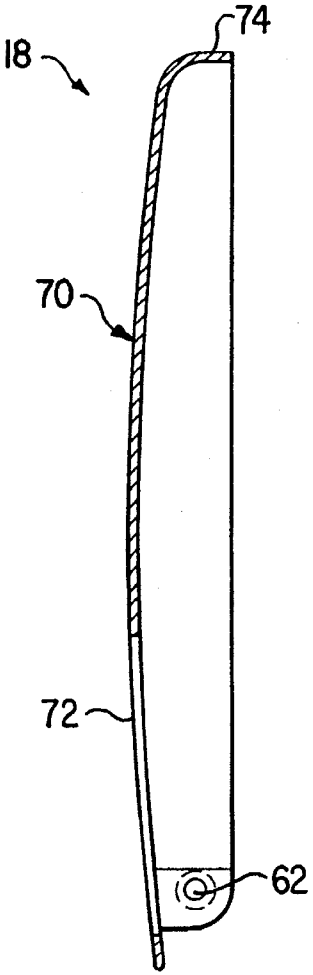
FIG. 8 is a right side elevational view of the cover of FIG. 7.
Figure 7:
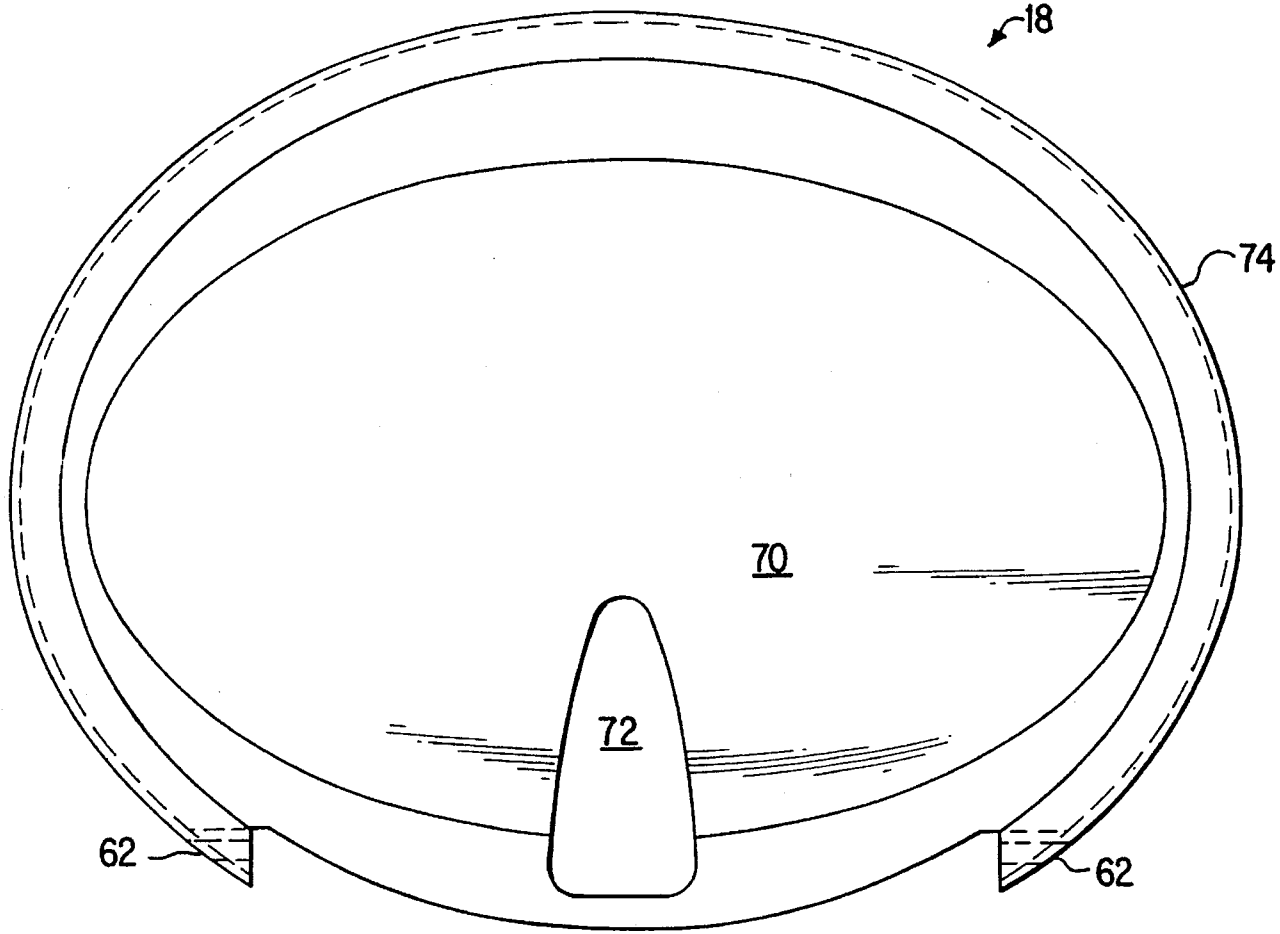
FIG. 7 is a front elevational view of the cover of the dispenser of FIG. 1.

As illustrated in FIGS. 5 and 6, midsection 16 includes a peripheral wall portion 43, a lower front wall 40, and a pair of lower side walls 42 extending rearwardly from the lateral ends of front wall 40 and downwardly from the lower ends of peripheral wall portion 43. Peripheral wall portion 43 extends around the periphery of the roll 5 and its rear edge is sized to mate against partial side periphery wall 22 of rear shell 14.

Adjacent their rear end, each side wall 42 includes inwardly facing projections 44, with a threaded hole 46 in each projection 44 extending generally parallel to the side walls 42. Midsection 16 is attached to lower extending portion 34 of rear wall 20 by conventional fastening hardware, e.g., screws 48, which extend through mounting holes 36 on lower extending portion 34, and are threadably received within holes 46. However, it is recognized that other fastening hardware and/or other mounting arrangements could be used to attach midsection 16 to lower extending portion 34. In an assembled state, as shown in FIGS. 1 and 2, the area between lower extending portion 34 of rear wall 20 and the lower front and side walls 40 and 42 of midsection 16 define bottom opening 50 which permits flexible sheet material 6 from dispensing roll 5 to be dispensed therethrough.

Front wall 40 of midsection 16 includes two stepped bores 52 and a center arcuate cut-away section 54. Each stepped bore 52 is identical to the stepped bores 38 on rear wall 20 and receives the other end of a respective roller support assembly 100. Center arcuate cut-away section 54 provides an enlarged area for enhanced access to the dispensing roll 5 by users, and thus, facilitates the withdrawal of sheet material 6 from the dispensing roll 5. Additionally, each side wall 42 of midsection 16 includes a cover mounting hole 56 near its upper end for pivotally attaching the cover 18 thereto.

Figure 9:
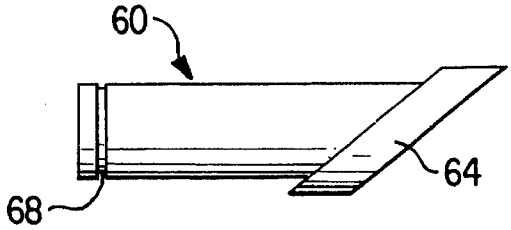
FIG. 9 is an elevational view of the cover pivot pin used in the dispenser of FIG. 1.

As depicted in FIGS. 1, 2, 7 and 8, cover 18 encases the front portion of housing 12 and protects the dispensing roll 5 from the environment and from vandalism. Cover 18 is attached to holes 56 in the upper region of midsection 16, and is pivotally movable about an axis 58 between a closed position for dispensing sheet material, shown in FIGS. 1 and 2, and an open position, not shown, for roll loading. A preferred arrangement to provide pivotal movement for cover 18 preferably includes a pair of pivot pins 60, one of which is shown in FIG. 9. Each pivot pin 60 extends through a hole 62 in cover 18 which is aligned with a hole 56 in midsection 16. Once assembled, each pivot pin 60 is retained by an angled shoulder 64 which prevents the pivot pin 60 from moving inward, and a locking ring 66 which fits within a groove 68 near the end of the pivot pin 60 and prevents the pivot pin 60 from moving outward. When cover 18 is pivoted about axis 58, the angled shoulders 64 are in contact with the outside surface of the cover 18 causing the pivot pins 60 to pivot with cover 18 around axis 58. It should be noted that while the illustrated embodiment depicts cover 18 as being pivotally attached to the lower side walls 42 of midsection 16 for pivotal movement around a lower horizontal axis, it is recognized that cover 18 can be pivotally attached to the top or a side of peripheral wall portion 43 to pivot the cover about a different axis, e.g., a vertical axis.

Cover 18 also includes a front section 70 with a viewing region 72, and a partial periphery wall section 74. Partial periphery wall section 74 extends rearwardly from front section 70 and around the periphery of cover 18 except for a bottom region. As shown in FIG. 2, the rear edge of partial periphery wall section 74 is sized and shaped to mate against the front edge of peripheral wall portion 43 of midsection 16. Thus, a complete periphery surface which bounds and protects the dispensing roll inside housing 12 is formed by partial periphery wall section 74 of cover, peripheral wall section 43 of midsection 16, and partial side periphery wall 22 of rear shell 14.

A conventional locking arrangement, not shown, is preferably located between peripheral wall portion 43 of midsection 16 and partial periphery wall section 74 of cover 18, and is used for selectively locking cover 18 in the closed position. The locking arrangement serves to prevent the cover 18 from being opened or damaged by non-authorized personnel, i.e., it is used as an anti-pilferage device.

Cover 18 is preferably made of a plastic material, which may be opaque, while viewing region 72 is preferably an aperture or made of an at least partially transparent material, e.g, a clear or smoked plastic. By this design, maintenance personnel can readily determine the existence and/or the size of the dispensing roll 5 without the need to unlock and open cover 18. Alternatively, cover 18 could be made entirely of a transparent or partially transparent material to enable the viewing of the dispensing roll 5 inside the dispenser 10.

Figure 10:
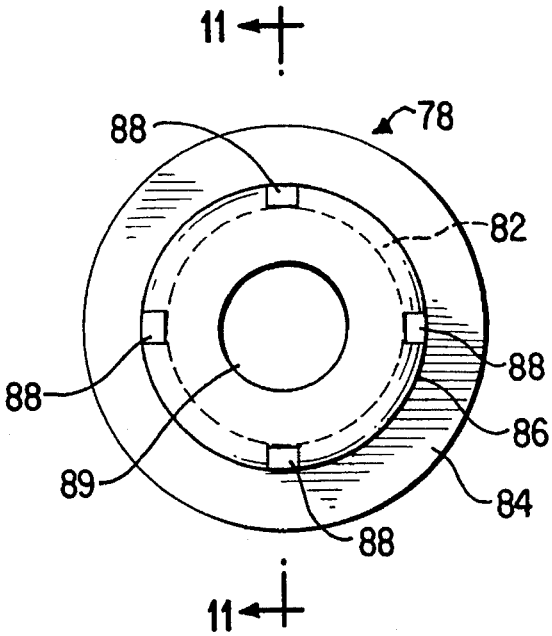
FIG. 10 is a front elevational view of the inner mandrel portion of the guide mandrel used in the dispenser of FIG. 1.
Figure 11:
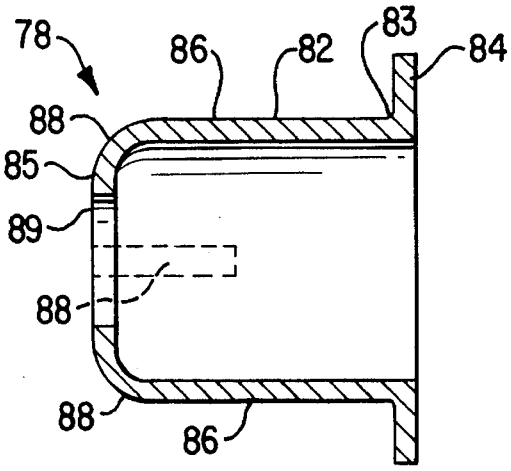
FIG. 11 is a cross-sectional view of the inner mandrel portion taken along line 11—11 of FIG. 10.
Figure 13:
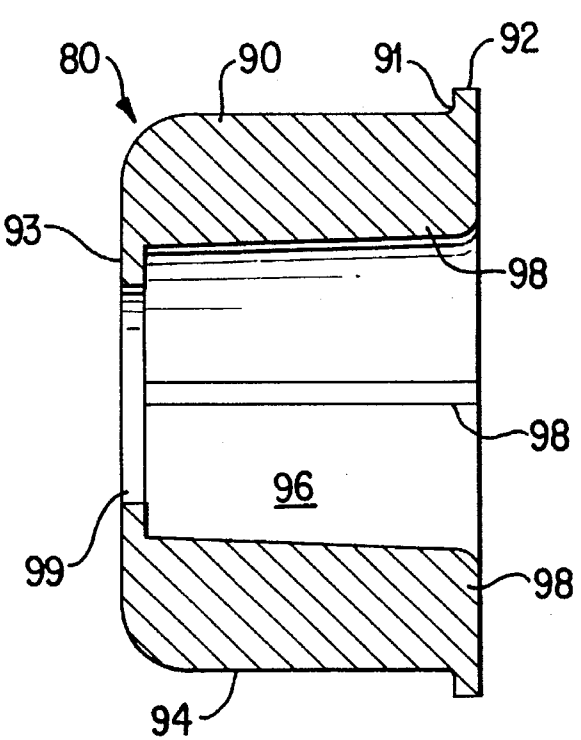
FIG. 13 is a cross-sectional view of the outer mandrel portion taken along line 13—13 of FIG. 12.
Figure 12:
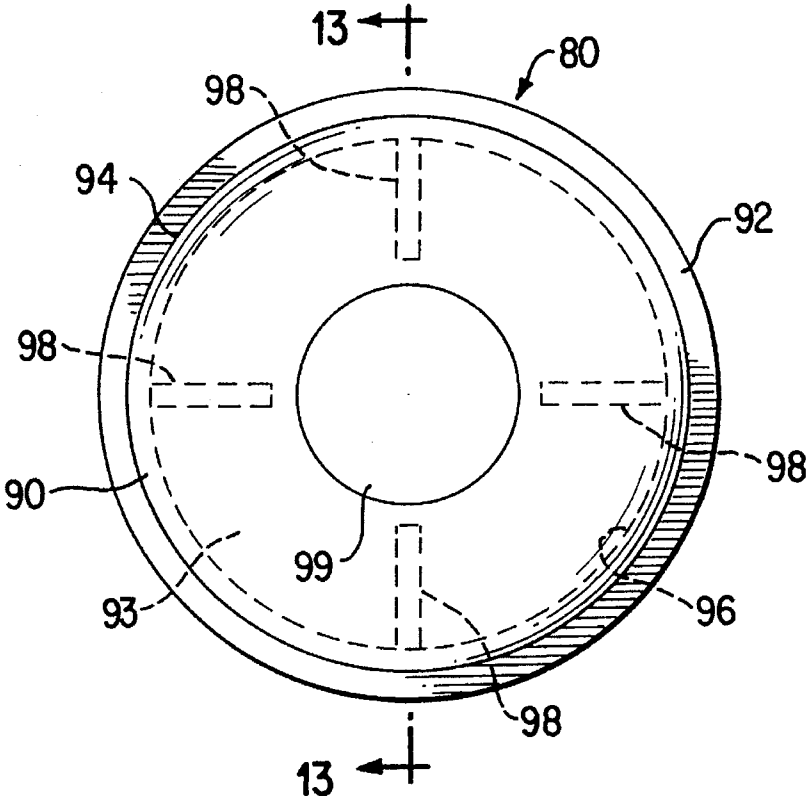
FIG. 12 is a from elevational view of the outer mandrel portion of the guide mandrel used in the dispenser of FIG. 1.

As illustrated in FIGS. 15–20, the guide mandrel 76 coaxially receives the dispensing roll 5. This causes the dispensing roll 5 to be inherently guided within the housing 12 by the guide slot 30 guiding the movement of mandrel 76. Guide mandrel 76 is comprised of an inner mandrel portion 78, as shown in FIGS. 10 and 11, and an outer mandrel portion 80, as shown in FIGS. 12 and 13. The mandrel portions 78 and 80 are coaxially attached to each other to form a single guide mandrel 76.

As shown in FIGS. 10 and 11, inner mandrel portion 78 has a substantially cylindrical body portion 82 and an outwardly extending annular flange 84 radiating from a first or rearward end 83 of body portion 82. To interface with outer mandrel portion 80, cylindrical body portion 82 of inner mandrel portion 78 includes an outer surface 86 with angularly spaced slots 88 therein which receive corresponding complementary structure located on the inside of outer mandrel portion 80. Slots 88 vary in depth from their deepest point adjacent the front or forward end 85 of body portion 82 to their rearward end. In the preferred embodiment, cylindrical body portion 82 includes four slots 88 angularly spaced 90° apart. However, it is recognized that more or less slots, or alternatively designed interfacing structure could be used.

As shown in FIGS. 12 and 13, outer mandrel portion 80 also has a cylindrical body portion 90 which includes a forward end 93 a rearward end 91. An outwardly extending flange 92 radiates from the rearward end 91 of body portion 90. Cylindrical body portion 90 further includes an outer surface 94 and an inner surface 96. Inner surface 96 has radially oriented wings 98 which are angularly disposed to align with, and frictionally press fit within, slots 88 in inner mandrel portion 78. In addition to this press fit relationship, the mandrel portions 78 and 80 are preferably further attached to each other by an additional technique, e.g., by welding or an adhesive. This permanently attaches the inner and outer mandrel portions 78 and 80 so they move as a unitary guide mandrel 76 when assembled. Additionally, outer surface 94 of outer mandrel portion 80 is sized to fit within the hollow core 7 of a dispensing roll 5 to guide the roll in dispenser housing 12.

Outer mandrel portion 80 and inner mandrel portion 78 are attached to each other such that cylindrical body portion 82 of inner mandrel portion 78 is located inside cylindrical body portion 90 of outer mandrel portion 80, and wings 98 are located inside slots 88. To assemble guide mandrel 76, it will be appreciated that inner mandrel portion 78 is inserted through vertical guide slot 30 with its cylindrical body portion 82 extending into the housing interior, and outer mandrel portion 80 is affixed concentrically to cylindrical body portion 82 by press fitting and/or an additional attachment technique.

When assembled, the outwardly extending annular flange 84 of inner mandrel portion 78 is located against the recessed surface 32 of rear wall 20 around vertical guide slot 30, and the cylindrical body portion 82 of inner mandrel portion 78 extends through the vertical guide slot 30 into the housing interior. Outwardly extending annular flange 92 of outer mandrel 80 is adjacent the forwardly facing surface 31 of guide slot 30 inside of rear wall 20, while cylindrical body portion 90 of outer mandrel 80 remains entirely inside the housing 12. The hollow core 7 of a dispensing roll 5 is placed around the outside surface 94 of cylindrical body portion 90 of outer mandrel portion 80 for the dispensing thereof. Additionally, the forward ends 85 and 93 of inner and outer mandrel portions 78 and 80 may include a respective hole therein, 89 and 99, to reduce the weight and cost of the mandrel 76. Guide mandrel 76 cooperates with each support roller assembly 100 to guide the dispensing roll 5 in the housing 12 and maintain its lower periphery adjacent the dispenser bottom 50 throughout the entire roll dispensing process.

Figure 14:
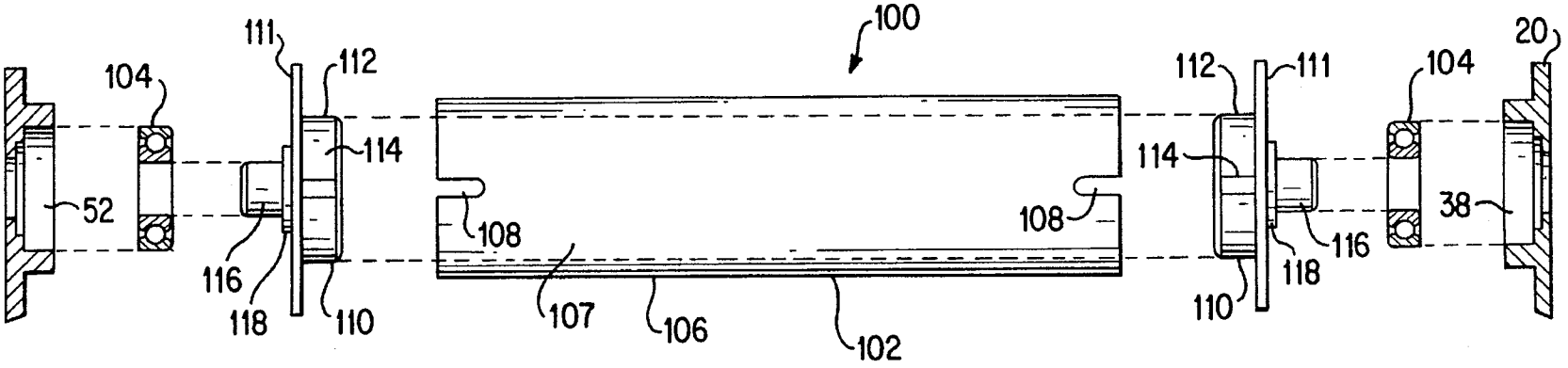
FIG. 14 is an exploded view of a support roller assembly of the dispenser of FIG. 1.
Figure 15:
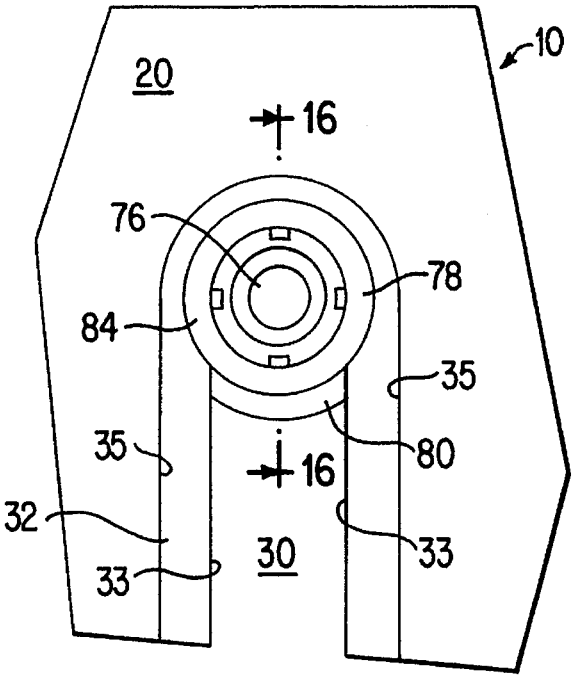
FIG. 15 is a rear elevational view of a portion of the dispenser of FIG. 1 showing the sliding guide mandrel and the guide track.

The support rollers 102 are symmetrically disposed with respect to dispensing roll 5 and its axis of rotation 9, such that they each bear approximately one-half of the weight of the roll 5. Each support roller assembly 100 includes a roller 102 which supports dispensing roll 5 by its lower periphery while it is being dispensed and guide mandrel 76 is travelling downward through vertical guide track 30. Roller assembly 102 extends substantially across the width of housing 12, i.e., from rear wall 20 of rear shell 14 to lower front wall 40 of midsection 16, and is rotatably mounted with respect to housing 12 by conventional hardware well known for accomplishing such a result. For example, each support roller assembly 100 preferably includes bearings 104 located at the ends of roller 102 facilitating the rotation thereof, as shown in FIG. 14. Roller 102 includes a main body 106 having a hollow center 107 and two slots 108 at each end. The slots 108 interface with roller cap inserts 110 fitted into the ends of hollow main body 106. Roller cap inserts 110 have an insert portion including an annular ring 112 and two radial projections 114, which are respectively complementary shaped for insertion into the hollow center 107 and the two slots 108. Inserts 110 further include a stop flange 111 so that tight tolerances between the roller cap inserts 110 and the main body 106, can be achieved.

On the opposite side of the stop flange 111, roller cap inserts 110 include centrally outwardly projecting shafts 116 and bearing flanges 118. Each projecting shaft 116 extends through a bearings 104 and into a respective bore 38 and 52. Bearing flanges 118 bear against the inner run of their respective bearing 104. Bores 38 and 52 have stepped surfaces which receive and house their respective bearing 104 and their respective shaft 116. Projecting shafts 116 and bearing flanges 118 interface with bearings 104 to facilitate the rotation of support roller 102. This arrangement significantly reduces the rotational friction coefficient of the roller 102, and facilitates the dispensing of sheet material from roll 5.

It is preferable that one or more rotatable rollers are used to support the dispensing rolls at its lower periphery during the dispensing process to facilitate the withdrawal of the sheet material 6 by reducing the friction applied to the dispensing roll. However, it is recognized that one or more smooth bars, belts, or other structures may possibly be used in lieu of rotatable support rollers to support dispensing roll.

Figure 16:
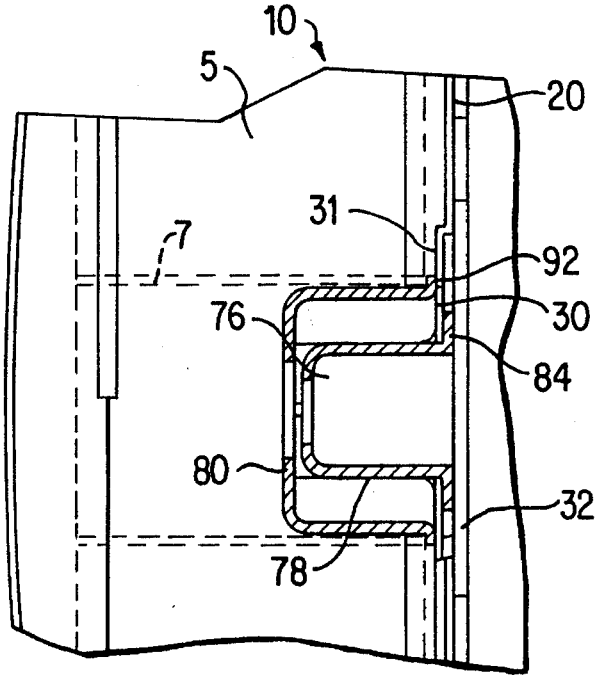
FIG. 16 is a cross-sectional view of the sliding guide mandrel and the guide track taken along line 16—16 of FIG. 15.
Figure 17:
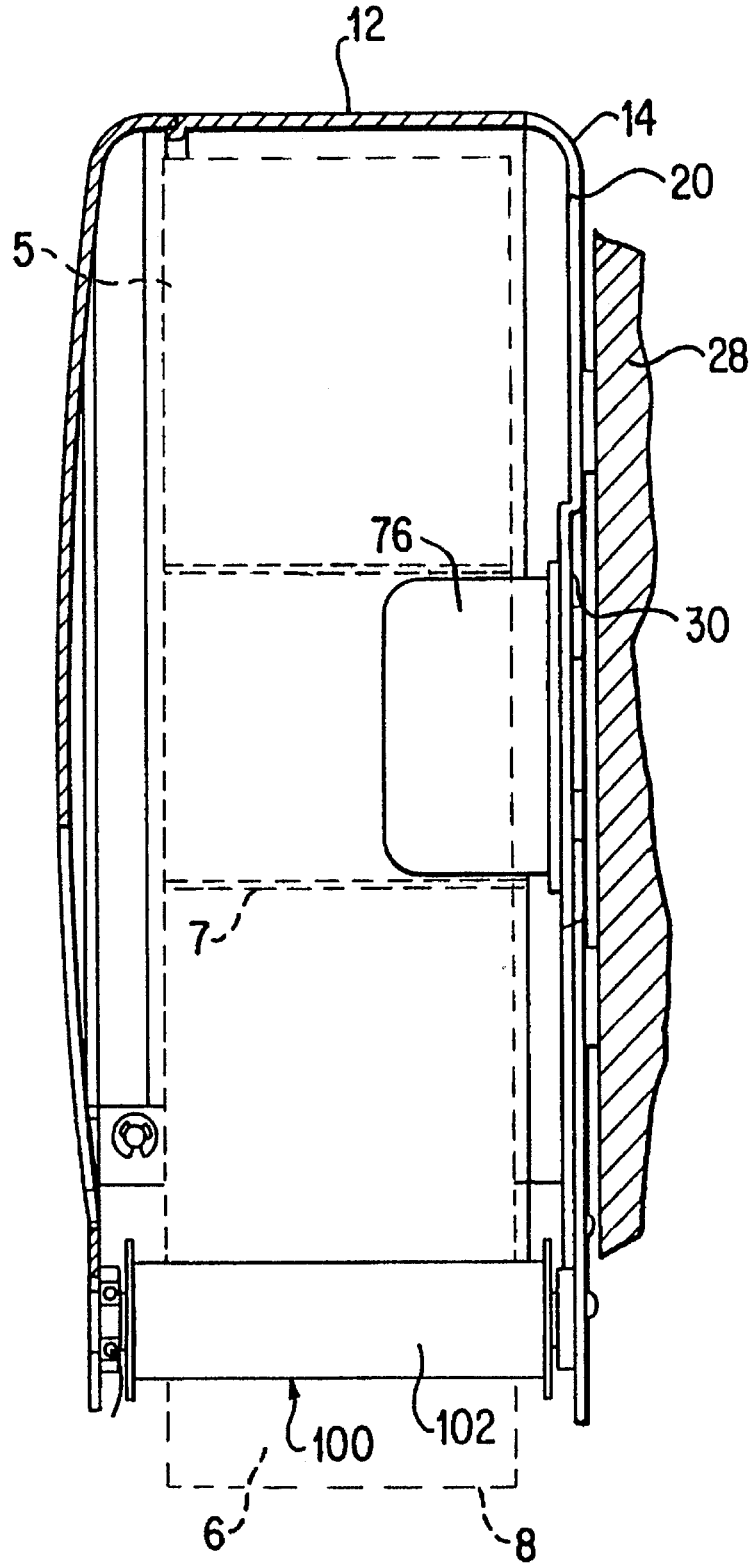
FIG. 17 is a schematic right side elevational view of the dispenser of FIG. 1 depicting a substantially full jumbo-sized toilet tissue roll loaded therein.
Figure 18:
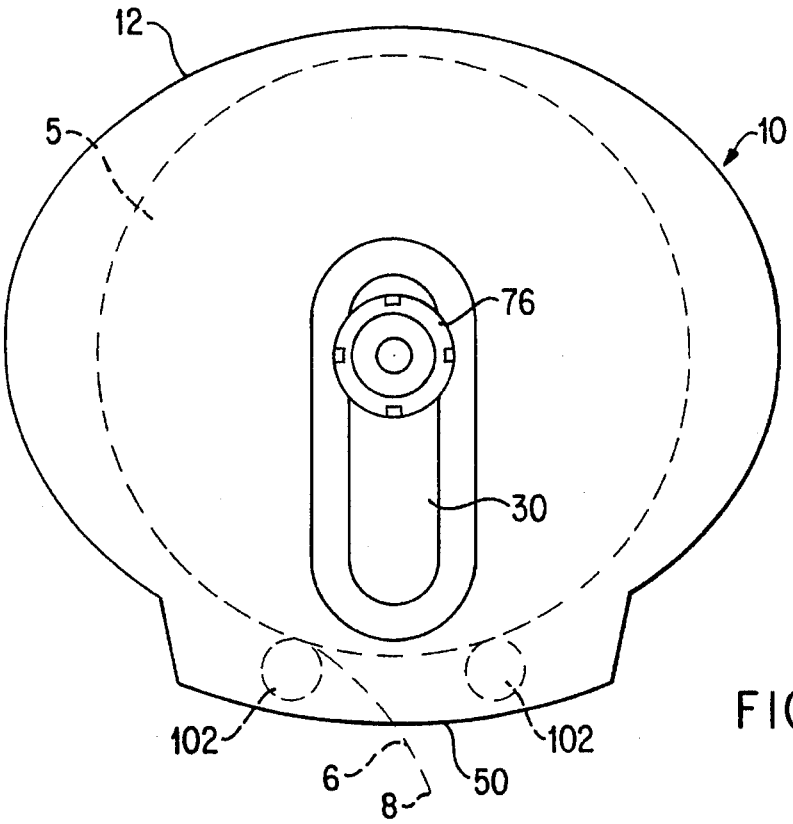
FIG. 18 is a schematic rear view of the dispenser shown in FIG. 17.
Figure 19:
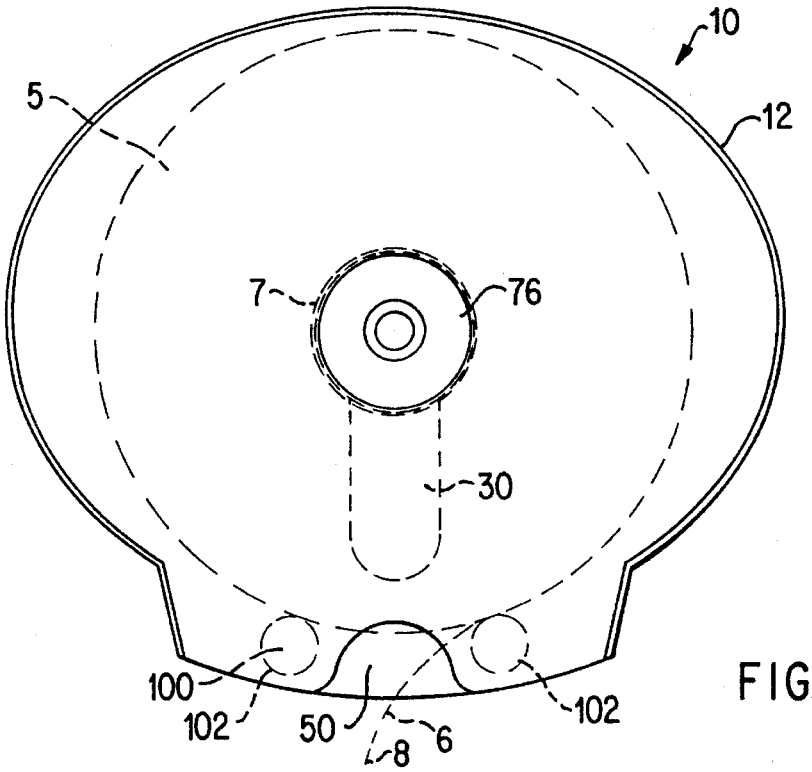
FIG. 19 is a schematic front view of the dispenser shown in FIG. 17.
Figure 20:
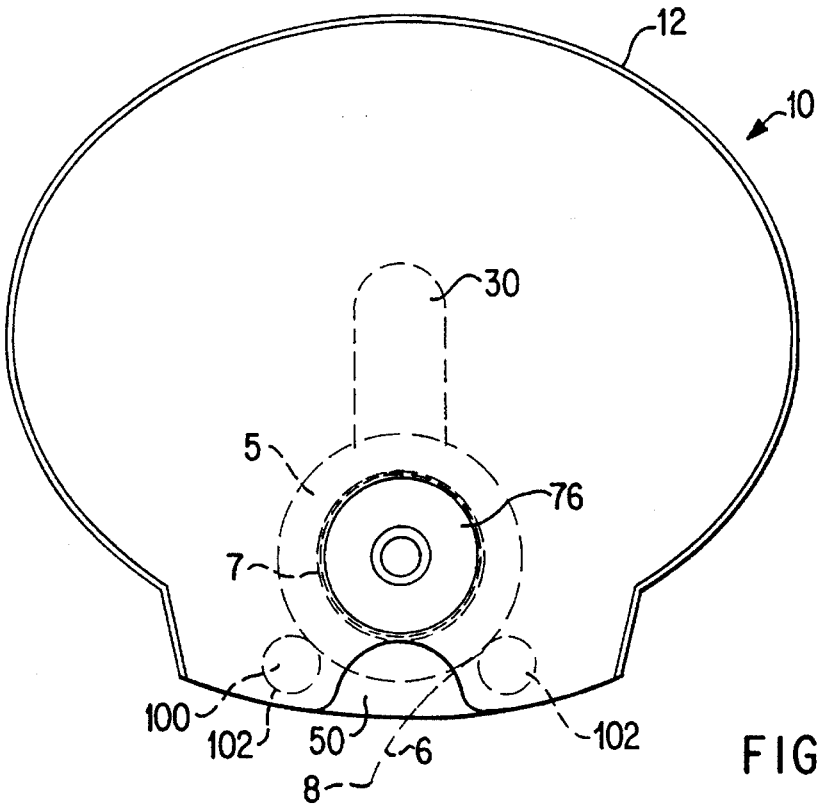
FIG. 20 is a schematic front view of the dispenser shown in FIG. 19 with the jumbo-sized toilet tissue roll depicted in a substantially depleted state.

The operation of dispenser 10 will now be described. Initially, dispenser 10 is mounted to a vertical supporting surface 28, e.g., a restroom stall wall, by attaching the rear shell 14 of rear wall 20 to the surface 28. With the cover 18 open, guide mandrel 76 is moved to the top of the guide slot 30, and the hollow core 7 of a dispensing roll 5 is placed concentrically around the outside of mandrel 76, which is formed by the outer surface 94 of outer mandrel portion 80. As shown in FIG. 16, the roll 5 axially fits over the majority of the guide mandrel 76, and the forward end of the guide mandrel 76 may or may not extend outside the core 7, depending upon the length of the guide mandrel 76 and the width of the roll 5. It is apparent that the roll 5 is loaded such that its axis of rotation 9 is perpendicular to the plane of supporting surface 28 and rear wall 20. While not necessary, the hollow core 7 and the outer surface 94 of guide mandrel 76 may be sized such to provide a friction fit therebetween causing the guide mandrel 76 to rotate with the dispensing roll 5 as it is being unwound, i.e., dispensed. However, the hollow core 7 may also be slightly larger than outer surface 94 of guide mandrel 76 so that the dispensing roll 5 rotates with respect to guide mandrel 76.

After the roll 5 is loaded onto mandrel 76, the dispensing roll 5 is released and the guide mandrel 76 will slide a small distance down guide slot 30 until the periphery of dispensing roll 5 is supported by support rollers 102. The cover 18 then is closed and locked, and sheet material may then be withdrawn from the dispenser 10 out bottom opening 50.

One-by-one, users dispense sheet material 6 from dispensing roll 5 by pulling on the tail 8 of the dispensing roll 5. To accomplish this, only a small pulling force on the tail is necessary because the dispenser roll 5 is supported by support rollers 102, and support rollers 102 have a very low coefficient of rotational friction due to their bearings 104. As dispensing roll 5 is being unwound, i.e., depleted, the floating nature of guide mandrel 76 maintains the bottom periphery of the roll 5 properly positioned on the support rollers 102, and simultaneously laterally guides the roll 5 via its core 7, within the housing 12. When the desired length of sheet material has been withdrawn, the user tears the sheet material along the closest perforation to separate the sheet material to the desired length for personal application.

Maintenance personnel can periodically determine whether dispenser replenishment is necessary by looking through the viewing region 72 in cover 18 to see if any sheet material 6 is remaining on dispensing roll 5. When the dispensing roll 5 has been depleted, or has been substantially depleted, authorized maintenance personnel may unlock the locking mechanism, open the cover 18, and remove the empty or almost empty roll 5 and its core 7 from the guide mandrel 76. The authorized maintenance personnel may then load a new dispensing roll 5 onto guide mandrel 76, and close and lock the cover 18 in the manner previously described. Sheet material from this roll may then be withdrawn. A new roll should be loaded into the dispenser each time the roll in the dispenser has been depleted.

Figure 21:
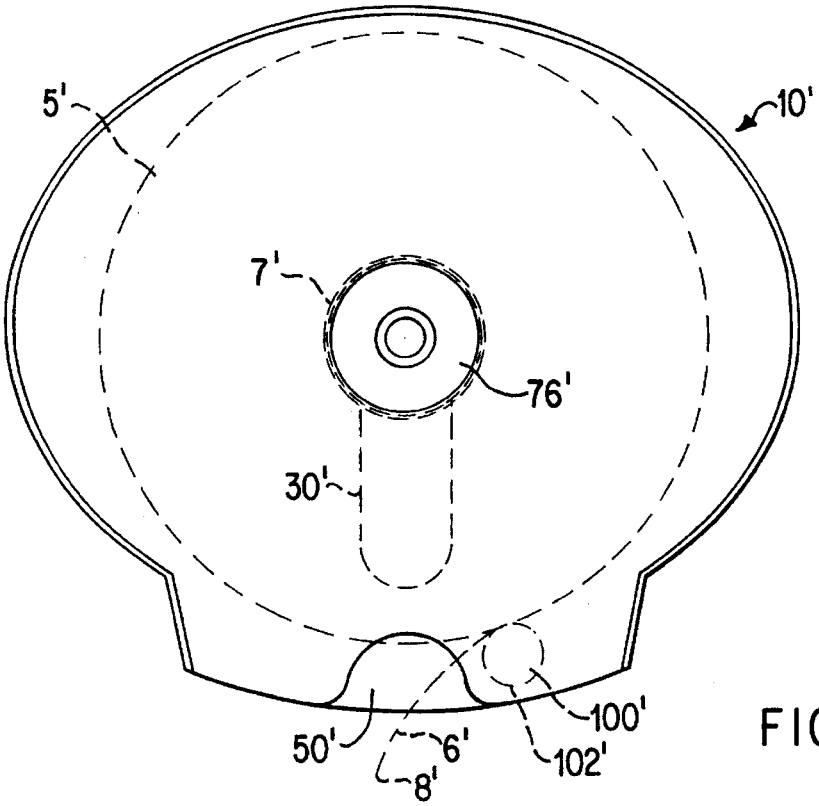
FIG. 21 is a schematic front view of another dispenser embodiment depicting a substantially full jumbo-sized toilet-tissue roll loaded therein.
Figure 22:
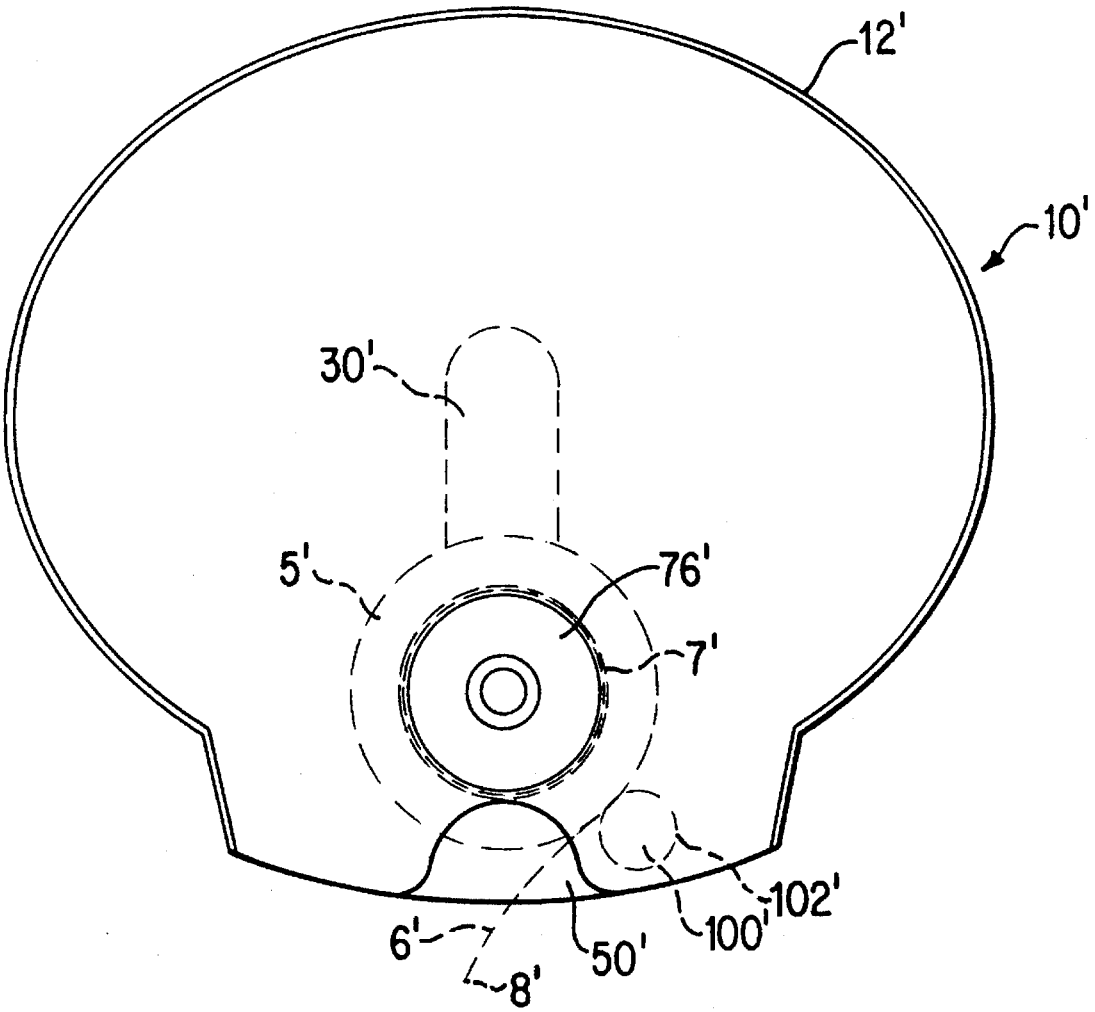
FIG. 22 is a schematic front view of the dispenser shown in FIG. 21 with the jumbo-sized toilet tissue roll depicted in a substantially depleted state.

An additional embodiment of the dispenser is shown in FIGS. 21 and 22, with common elements designated by the same reference numerals primed. Dispenser 10' is preferably substantially identical to dispenser 10 as shown in FIGS. 1–20, except that dispenser 10' only includes a single support roller assembly 100'. As with the roller support assemblies 100 shown in FIGS. 1–20, roller support assembly 100' includes a support roller 102', bearings, and stepped bores in the rear wall of rear shell and in the lower front wall of the midsection. The support roller 102' is laterally offset with respect to dispensing roll 5' and its axis of rotation 9', and facilitates the withdrawal of the tissue paper 6' out of the dispenser bottom 50' as it also has a very low coefficient of rotational friction due to its bearings. The guide mandrel 76' maintains the bottom periphery of the roll 5' properly positioned on the support roller 102', and simultaneously laterally guides the roll 5' via its core 7', within the housing 12'.

In both embodiments, the guide mandrel and guide slot system prevents spent cores from falling on the floor, guides the roll accurately in the vertical and horizontal planes, allows for ease of roll loading, and maintains the roll close to the bottom of dispenser for easy access. The guide mandrel and guide slot system is also advantageous because it accurately locates the roll within the dispenser housing and adjacent the dispenser opening throughout the dispensing process.

Additionally, the guide mandrel only extends through one wall surface. More specifically the guide mandrel only extends through the rear wall of the dispenser. This creates a number of advantages. First, the guide mandrel does not need to extend through the roll or directly interface with the cover. Second, as only one guide slot is necessary for guiding the mandrel and the roll, the dispenser can be composed of dispenser parts which may be inexpensive and/or easy to manufacture and assemble. Third, the dispenser can be more compact and thereby maximize the available housing space. Lastly, as the only guide slot is located on the wall attached to the restroom stall wall, it makes the dispenser, and more specifically the guide mandrel and the guide slot arrangement, less prone to tampering because the guide mandrel and the guide slot are inaccessible to users.

The component pieces of the dispensers 10 and 10' may comprise known suitable materials such as plastics and metals, and be formed with conventional manufacturing techniques. Preferably, the above-described dispenser components are formed of rigid plastic, e.g., a thermoplastic.

While particular embodiments of the invention have been shown and described, it is recognized that various modifications thereof will occur to those skilled in the art. Therefore, the scope of the herein-described invention shall be limited solely by the claims appended hereto.

What is claimed is:

1. A dispenser for storing and dispensing flexible sheet material from a roll having an axis of rotation, a periphery surface and a hollow core, said dispenser comprising:

a housing for containing the roll of flexible sheet material to be dispensed, said housing including a first wall having a closed guide track, and an opening for dispensing the flexible sheet material from the roll therethrough, said guide track having opposed vertical surfaces, an upper surface, and a lower surface;

a guide mandrel, said guide mandrel having a first portion slidably retained between said opposed vertical surfaces, said upper surface and said lower surface of said guide track, and a second portion positionable within the hollow core of the roll of flexible sheet material; and a support member, said support member being mounted for rotation about a first axis located below the axis of rotation of the roll, said support member positioned adjacent said opening in contact with the periphery surface of the roll, and supporting the roll during the dispensing of the flexible sheet material from the roll.

2. The dispenser of claim 1, wherein said support member is rotatably coupled to said first wall.

3. The dispenser of claim 1, said first wall including a slot therein forming said guide track, said first portion of said guide mandrel extending through said slot.

4. The dispenser of claim 1, wherein said housing includes a bottom, said opening located at the bottom of the housing for dispensing the flexible sheet material out through the bottom of the housing, said first wall having mounting means for mounting the dispenser to a supporting surface.

5. The dispenser of claim 1, wherein said second portion of said guide mandrel includes a generally cylindrical body, said first portion of said guide mandrel including first and second outwardly extending annular flanges, said guide track being located between said first and second outwardly extending flanges.

6. The dispenser of claim 5, wherein said guide mandrel is substantially comprised of a first mandrel member and a second mandrel member, said first and second mandrel members fixedly attached to each other, said first mandrel member including said first outwardly extending flange and said second mandrel member including said second outwardly extending flange.

7. The dispenser of claim 5, wherein said guide track includes a guide slot formed in a recessed portion of said first wall, said first outwardly extending flange travelling within said recessed portion.

8. The dispenser of claim 1, wherein said opening is defined as the area between a plurality of wall surfaces, said plurality of wall surfaces comprised of generally smooth edges void of serrations.

9. The dispenser of claim 1, further comprising a plurality of bearing means coupled to said support member for reducing the rotational resistance of said support member.

10. The dispenser of claim 1, wherein said guide mandrel includes a forward end on the second portion of the guide mandrel opposite from said first portion, said forward end being sized to be located inside said hollow core of the roll to be dispensed.

11. The dispenser of claim 1, wherein the roll and said guide mandrel are coupled such that they are movable with respect to each other when the flexible sheet material is dispensed from the dispenser.

12. The dispenser of claim 1, wherein the roll and said guide mandrel are coupled such that they rotate together about the axis of rotation of the roll when the flexible sheet material is dispensed from the dispenser.

13. The dispenser of claim 1, wherein said support member is a first support member, said dispenser further comprising a second support member spaced from said first support member, said second support member being mounted for rotation about a second axis located below the axis of rotation of the roll, said second support member positioned adjacent said opening in contact with the periphery surface of the roll and supporting the roll during the dispensing of the flexible sheet material from the roll.

14. The dispenser of claim 1, wherein said dispenser includes only one guide track for guiding the movement of the roll.

15. The dispenser of claim 1, wherein said dispenser is sized to permit the dispensing of sheet material from rolls having an initial diameter of at least eight inches.

16. A dispenser for storing and dispensing flexible sheet material from a roll having an axis of rotation, a periphery surface and a hollow core, said dispenser comprising:

a housing for containing the roll of flexible sheet material to be dispensed, said housing including a first wall having a guide track, and an opening for dispensing the flexible sheet material from the roll therethrough;

a guide mandrel, said guide mandrel having a first portion slidably retained within said guide track, and a second portion positionable within the hollow core of the roll of flexible sheet material; and a support member, said support member being mounted for rotation about a first axis located below the axis of rotation of the roll, said support member positioned adjacent said opening in contact with the periphery surface of the roll, and supporting the roll during the dispensing of the flexible sheet material from the roll;

wherein mid housing includes a bottom, said opening located at the bottom of the housing for dispensing the flexible sheet material out through the bottom of the housing, said first wall having mounting means for mounting the dispenser to a supporting surface; and wherein said housing further includes a second wall generally opposed from said first wall, said guide mandrel having an end on the second portion distal from said first portion, said distal end located between said first and second walls and spaced a predetermined distance from said second wall.

17. A dispenser for storing and dispensing flexible sheet material from a roll having an axis of rotation, a periphery surface and a hollow core, said dispenser comprising:

a housing for containing the roll of flexible sheet material to be dispensed, said housing including a first wall having a guide track, and an opening for dispensing the flexible sheet material from the roll therethrough;

a guide mandrel, said guide mandrel having a first portion slidably retained within said guide track, and a second portion positionable within the hollow core of the roll of flexible sheet material; and a support member, said support member being mounted for rotation about a first axis located below the axis of rotation of the roll, said support member positioned adjacent said opening in contact with the periphery surface of the roll, and supporting the roll during the dispensing of the flexible sheet material from the roll;

wherein said dispenser includes surfaces for permanently retaining said guide mandrel within said guide track.

18. The dispenser of claim 17, wherein said guide track includes said surfaces for permanently retaining said guide mandrel within said guide track.

19. A dispenser for storing and dispensing flexible sheet material from a roll having an axis of rotation, a periphery surface and a hollow core, said dispenser adapted to be mounted to a planar supporting surface, said dispenser comprising:

a housing containing the roll of flexible sheet material to be dispensed, said housing including first and second opposing walls and an opening for dispensing the flexible sheet material from the roll therethrough, said first wall being adapted for attachment to the planar supporting surface;

a guide track on said first wall defining a path of travel for the roll as it is being dispensed;

a guide mandrel positioned within the hollow core of the roll, said guide mandrel having opposing first and second end portions, said first end portion retained within said guide track for slidable movement with respect thereto, and said second end portion located within the housing between said first and second walls;

a first support member contacting the periphery surface of the roll and supporting the roll during the dispensing of flexible sheet material; and a second support member spaced from said first support member, said second support member contacting the periphery surface of the roll and supporting the roll during the dispensing of flexible sheet material.

20. The dispenser of claim 19, wherein the planar supporting surface defines a first plane, said first and second support members supporting said roll such that the axis of rotation of the roll is perpendicular to the first plane.

21. The dispenser of claim 20, wherein said first and second support members are mounted for rotation about respective axes which are parallel to said axis of rotation of the roll and perpendicular to the first plane.

22. The dispenser of claim further comprising spacing means on said first wall for spacing the guide track a predetermined distance away from the planar supporting surface permitting the guide mandrel to travel within the guide track without hinderance.

23. The dispenser of claim 22, wherein said spacing means includes an inwardly recessed portion on said first wall, said inwardly recessed portion spacing the guide track a predetermined distance away from the first wall.

24. A dispenser for storing and dispensing flexible sheet material from a roll having an axis of rotation, a periphery surface and a hollow core, said dispenser adapted to be mounted to a planar supporting surface, said dispenser comprising:

a housing containing the roll of flexible sheet material to be dispensed, said housing including first and second opposing walls and an opening for dispensing the flexible sheet material from the roll therethrough, said first wall being adapted for attachment to the planar supporting surface;

a guide track on said first wall defining a path of travel for the roll as it is being dispensed;

a guide mandrel positioned within the hollow core of the roll, said guide mandrel having opposing first and second end portions, said first end portion retained within said guide track for slidable movement with respect thereto, and said second end portion located within the housing between said first and second walls; and a support member contacting the periphery surface of the roll and supporting the roll during the dispensing of flexible sheet material;

wherein the planar supporting surface defines a first plane, said support member supporting said roll such that the axis of rotation of the roll is perpendicular to the first plane;

further comprising spacing means on said first wall for spacing the guide track a predetermined distance away from the planar supporting surface permitting the guide mandrel to travel within the guide track without hindrance;

wherein said spacing means includes a plurality of raised spacer members on said first wall, said plurality of raised spacer members spacing the first wall a predetermined distance away from the planar supporting surface.

25. A dispenser for storing and dispensing flexible sheet material from a roll having an initial diameter of at least eight inches, an axis of rotation, a periphery surface, and a hollow core, said dispenser comprising:

a housing, said housing sized for containing the roll of flexible sheet material, said housing includes an opening for withdrawal of sheet material therethrough; and roll supporting and guiding means for supporting the roll by its periphery during the entire dispensing of sheet material and for guiding the roll along a predetermined path during the entire dispensing of sheet material, whereby a portion of the periphery of the roll is maintained adjacent the opening during the entire dispensing of sheet material from the roll;

said roll supporting and guiding means includes: a first support member located below the axis of rotation of the roll and adjacent the opening for contacting and supporting the periphery of the roll during the dispensing of flexible sheet material from the roll, a second support member spaced from said first support member and located below the axis of rotation of the roll and adjacent the opening for contacting and supporting the periphery of the roll during the dispensing of flexible sheet material from the roll, a guide track, and a guide mandrel slidably retained within mid guide track, the guide mandrel positioned within the hollow core of the roll, said first and said second support members rotatably mounted to said housing.

26. A dispenser for storing and dispensing flexible sheet material from a roll having an axis of rotation, a periphery surface and a hollow core, said dispenser comprising:

a housing for containing the roll of flexible sheet material to be dispensed, said housing including a plurality of walls including a first wall having a guide track for guiding the movement of the roll as it is dispensed, and an opening for dispensing the flexible sheet material from the roll therethrough, said housing containing only one guide track for guiding the movement of the roll as it is dispensed;

a guide mandrel, said guide mandrel having a first portion slidably retained within said guide track, and a second portion positionable within the hollow core of the roll of flexible sheet material; and a support member, said support member being mounted for rotation about a first axis located below the axis of rotation of the roll, said support member positioned adjacent said opening in contact with the periphery surface of the roll, and supporting the roll during the dispensing of the flexible sheet material from the roll.

27. The dispenser of claim 26, wherein said support member is rotatably coupled to said first wall.

28. The dispenser of claim 26, said first wall including a slot therein forming said guide track, said first portion of said guide mandrel extending through said slot.

29. The dispenser of claim 26, wherein said housing includes a bottom, said opening located at the bottom of the housing for dispensing the flexible sheet material out through the bottom of the housing, said first wall having mounting means for mounting the dispenser to a supporting surface.

30. The dispenser of claim 29, wherein said housing further includes a second wall generally opposed from said first wall, said guide mandrel having an end on the second portion distal from said first portion, said distal end located between said first and second walls and spaced a predetermined distance from said second wall.

31. The dispenser of claim 26, wherein said second portion of said guide mandrel includes a generally cylindrical body, said first portion of said guide mandrel including first and second outwardly extending annular flanges, said guide track being located between said first and second outwardly extending flanges.

32. The dispenser of claim 31, wherein said guide mandrel is substantially comprised of a first mandrel member and a second mandrel member, said first and second mandrel members fixedly attached to each other, said first mandrel member including said first outwardly extending flange and said second mandrel member including said second outwardly extending flange.

33. The dispenser of claim 31, wherein said guide track includes a guide slot formed in a recessed portion of said first wall, said first outwardly extending flange traveling within said recessed portion.

34. The dispenser of claim 26, wherein said opening is defined as the area between said plurality of wall surfaces, said plurality of wall surfaces comprised of generally smooth edges void of serrations.

35. The dispenser of claim 26, further comprising a plurality of bearing means coupled to said support member for reducing the rotational resistance of said support member.

36. The dispenser of claim 26, wherein said guide mandrel is permanently retained within said guide track.

37. The dispenser of claim 26, wherein said guide mandrel includes a forward end on the second portion of the guide mandrel opposite from said first portion, said forward end being sized to be located inside said hollow core of the roll to be dispensed.

38. The dispenser of claim 26, wherein the roll and said guide mandrel are coupled such that they are movable with respect to each other when the flexible sheet material is dispensed from the dispenser.

39. The dispenser of claim 26, wherein roll and said guide mandrel are coupled such that they rotate together about the axis of rotation of the roll when the flexible sheet material is dispensed from the dispenser.

40. The dispenser of claim 26, wherein said support member is a first support member, said dispenser further comprising a second support member spaced from said first support member, said second support member being mounted for rotation about a second axis located below the axis of rotation of the roll, said second support member positioned adjacent said opening in contact with the periphery surface of the roll and supporting the roll during the dispensing of the flexible sheet material from the roll.

41. The dispenser of claim 26, wherein said dispenser is sized to permit the dispensing of sheet material from rolls having an initial diameter of at least eight inches.

* * * * *

UNITED STATES PATENT AND TRADEMARK OFFICE

CERTIFICATE OF CORRECTION

PATENT NO. : 5,601,253

DATED : February 11, 1997

INVENTOR(S) : John S. Formon and Stephanie McIntyre

It is certified that error appears in the above-indentified patent and that said Letters Patent is hereby corrected as shown below:

COLUMNS 11, 12, & 14:

Claim 16, line 18, replace "mid" with --said--.

Claim 22, line 1, after the word "claim" insert --20--.

Claim 39, line 1, after the word "wherein" insert --the--.

Signed and Sealed this

Thirteenth Day of May, 1997

Bruce Lehman

*Attest:*

BRUCE LEHMAN

*Attesting Officer*

*Commissioner of Patents and Trademarks*